US007928857B2

(12) United States Patent
Olesen et al.

(10) Patent No.: US 7,928,857 B2
(45) Date of Patent: Apr. 19, 2011

(54) CONSOLE ASSEMBLY FOR A DISHWASHING APPLIANCE, AND ASSOCIATED APPARATUS

(75) Inventors: Jerry Olesen, Kinston, NC (US); Joseph H. Vezzosi, Milford, NJ (US); Greg Van Vooren, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 251 days.

(21) Appl. No.: 12/275,321

(22) Filed: Nov. 21, 2008

(65) Prior Publication Data

US 2010/0127851 A1 May 27, 2010

(51) Int. Cl.
*G08B 21/00* (2006.01)

(52) U.S. Cl. ..... 340/686.1

(58) Field of Classification Search ..... 340/686.1, 340/525, 691.6, 545.6; 134/56 D, 113
See application file for complete search history.

(56) References Cited

U.S. PATENT DOCUMENTS

| | | | | |
|---|---|---|---|---|
| 5,151,884 | A * | 9/1992 | Griffith et al. | 368/10 |
| 5,365,959 | A * | 11/1994 | Favaro | 134/113 |
| 5,453,586 | A | 9/1995 | Stottmann | |
| 7,201,175 | B2 * | 4/2007 | DeBoer et al. | 134/57 D |
| 7,296,236 | B2 | 11/2007 | King | |
| 2002/0038553 | A1 | 4/2002 | Yun et al. | |
| 2002/0116959 | A1 * | 8/2002 | Ohta et al. | 68/12.27 |
| 2005/0212652 | A1 | 9/2005 | Ludenia | |
| 2006/0123680 | A1 | 6/2006 | Hering et al. | |
| 2008/0011341 | A1 * | 1/2008 | Kim et al. | 134/56 D |
| 2008/0011342 | A1 | 1/2008 | Ryu et al. | |
| 2008/0273016 | A1 | 11/2008 | Helgesen | |

FOREIGN PATENT DOCUMENTS

| | | | |
|---|---|---|---|
| DE | 198 59 978 | A1 | 6/2000 |
| DE | 198 59 980 | A1 | 6/2000 |
| DE | 102 36 937 | A1 | 2/2004 |
| EP | 0 691 100 | A1 | 1/1996 |
| EP | 0 943 286 | A1 | 9/1999 |

OTHER PUBLICATIONS

International Search Report and Written Opinion issued in connection with corresponding International Application No. PCT/US2009/065054 and mailed on Mar. 4, 2010.

* cited by examiner

*Primary Examiner* — Phung Nguyen
(74) *Attorney, Agent, or Firm* — Alston & Bird LLP

(57) ABSTRACT

A dishwashing appliance console assembly and associated apparatus are provided. The console assembly comprises a control device arrangement, including a control actuator having an associated indicia, and a light emitting element that is de-actuated when the door assembly is in the closed position, and actuated when the door assembly is pivoted from the closed position. The light emitting element communicates with a light diffuser member, and the emitted light interacts therewith to illuminate the indicia associated with the control actuator. A console cover member at least partially covers the control device arrangement and facilitates interaction with the control actuator therethrough. The console cover member is configured such that the light from the diffuser member illuminating the indicia is non-specifically directed therethrough. The console cover member is substantially opaque when the light emitting element is de-actuated, and at least partially translucent when the light emitting element is actuated.

14 Claims, 4 Drawing Sheets

CONSOLE ASSEMBLY FOR A DISHWASHING APPLIANCE, AND ASSOCIATED APPARATUS

BACKGROUND OF THE INVENTION

1. Field of the Invention

Embodiments of the present invention relate to dishwashing appliances and, more particularly, to a console assembly for a dishwashing appliance, and an apparatus associated therewith.

2. Description of Related Art

A washing appliance, such as a dishwasher, generally includes a tub portion defining a forward access opening, wherein a door assembly is engaged with the tub portion so as to be pivotable about the lower end of the tub portion between a closed position and an open position, and to close the forward access opening during the dishwashing process. Such dishwashers may be electronically-controlled, implementing an electronic control assembly for interacting with various components (i.e., circulation pump, drain pump, water valve) of the dishwasher to control a dishwashing process. In such instances, the performed functions (i.e., wash, rinse, drain, heated dry) of a cycle, or various cycles, may be selected by a user via one or more appropriate selector devices or actuator devices, such as one or more switches, buttons, knobs, or combinations thereof, associated with a control device arrangement in communication with the control assembly. The control device arrangement may be disposed remotely with respect to the control assembly. For example, the selector or actuator devices may be disposed about the upper end of the door assembly of the dishwasher for facilitating interaction therewith by a user. In such dishwashers, the control device arrangement may undesirably be unconcealed and clearly visible when the dishwasher is not being programmed to direct operation of a dishwashing program (i.e., when the door assembly is in the open position). In other instances, such a control device arrangement about the upper end of the door assembly, though readily accessible by users, may undesirably be exposed to the humid environment associated with the dishwasher and, if not fluid-tight or resistant, may be at risk of failure due to such conditions.

Thus, there exists a need for an apparatus for a dishwashing appliance capable of concealing the control device arrangement and/or any selector/actuator devices associated therewith, while also providing a substantially fluid-tight control device arrangement that is easily accessible by the user of the dishwashing appliance.

BRIEF SUMMARY OF THE INVENTION

The above and other needs are met by the present invention which, according to one aspect, provides a console assembly for a dishwashing appliance having a tub portion defining a forward access opening, and a door assembly pivotably engaged therewith, wherein the door assembly is movable between an open position and a closed position. The door assembly in the closed position cooperates with the tub portion to cover the forward access opening, and the door assembly defines an upper end opposed to a lower end with respect to the forward access opening. The console assembly is adapted to operably engage the upper end and comprising a control device arrangement, including a control actuator having an indicia associated therewith, wherein the control actuator is adapted to selectively direct operation of at least one operational component of the dishwashing appliance. A light emitting element is associated with the control actuator, wherein the light emitting element is configured so as to be de-actuated when the door assembly is in the closed position, and to be actuated to emit light when the door assembly is pivoted from the closed position. A light diffuser member is in communication with the light emitting element such that light emitted thereby interacts with the light diffuser member to illuminate the indicia associated with the control actuator. A console cover member is configured to at least partially cover the control device arrangement and to facilitate interaction with the control actuator therethrough. The console cover member is also configured such that the light from the diffuser member illuminating the indicia is non-specifically directed therethrough. The console cover member is further configured to be substantially opaque when the light emitting element is de-actuated, to prevent observation of the indicia associated with the control actuator when the door assembly is in the closed position, and to be at least partially translucent when the light emitting element is actuated, upon the door assembly being pivoted from the closed position, so as to allow observation of the indicia associated with the control actuator.

Another aspect provides a dishwashing appliance comprising a tub portion defining a forward access opening, and a door assembly pivotably engaged with the tub portion and movable between an open position and a closed position, wherein the door assembly in the closed position cooperates with the tub portion to cover the forward access opening, and wherein the door assembly defines an upper end opposed to a lower end with respect to the forward access opening. A console assembly is operably engaged with the door assembly about the upper end thereof, and comprises a control device arrangement, including a control actuator having an indicia associated therewith, wherein the control actuator is adapted to selectively direct operation of at least one operational component of the dishwashing appliance. A light emitting element is associated with the control actuator, wherein the light emitting element is configured so as to be de-actuated when the door assembly is in the closed position, and to be actuated to emit light when the door assembly is pivoted from the closed position. A light diffuser member is in communication with the light emitting element such that light emitted thereby interacts with the light diffuser member to illuminate the indicia associated with the control actuator. A console cover member is configured to at least partially cover the control device arrangement and to facilitate interaction with the control actuator therethrough. The console cover member is also configured such that the light from the diffuser member illuminating the indicia is non-specifically directed therethrough. The console cover member is further configured to be substantially opaque when the light emitting element is de-actuated, to prevent observation of the indicia associated with the control actuator when the door assembly is in the closed position, and to be at least partially translucent when the light emitting element is actuated, upon the door assembly being pivoted from the closed position, so as to allow observation of the indicia associated with the control actuator.

Thus, various aspects of the present invention provide advantages, as otherwise detailed herein, that may include, but are not limited to: concealing a control device arrangement of a dishwasher when the control device arrangement is not in use.

BRIEF DESCRIPTION OF THE SEVERAL VIEWS OF THE DRAWINGS

Figure 1:
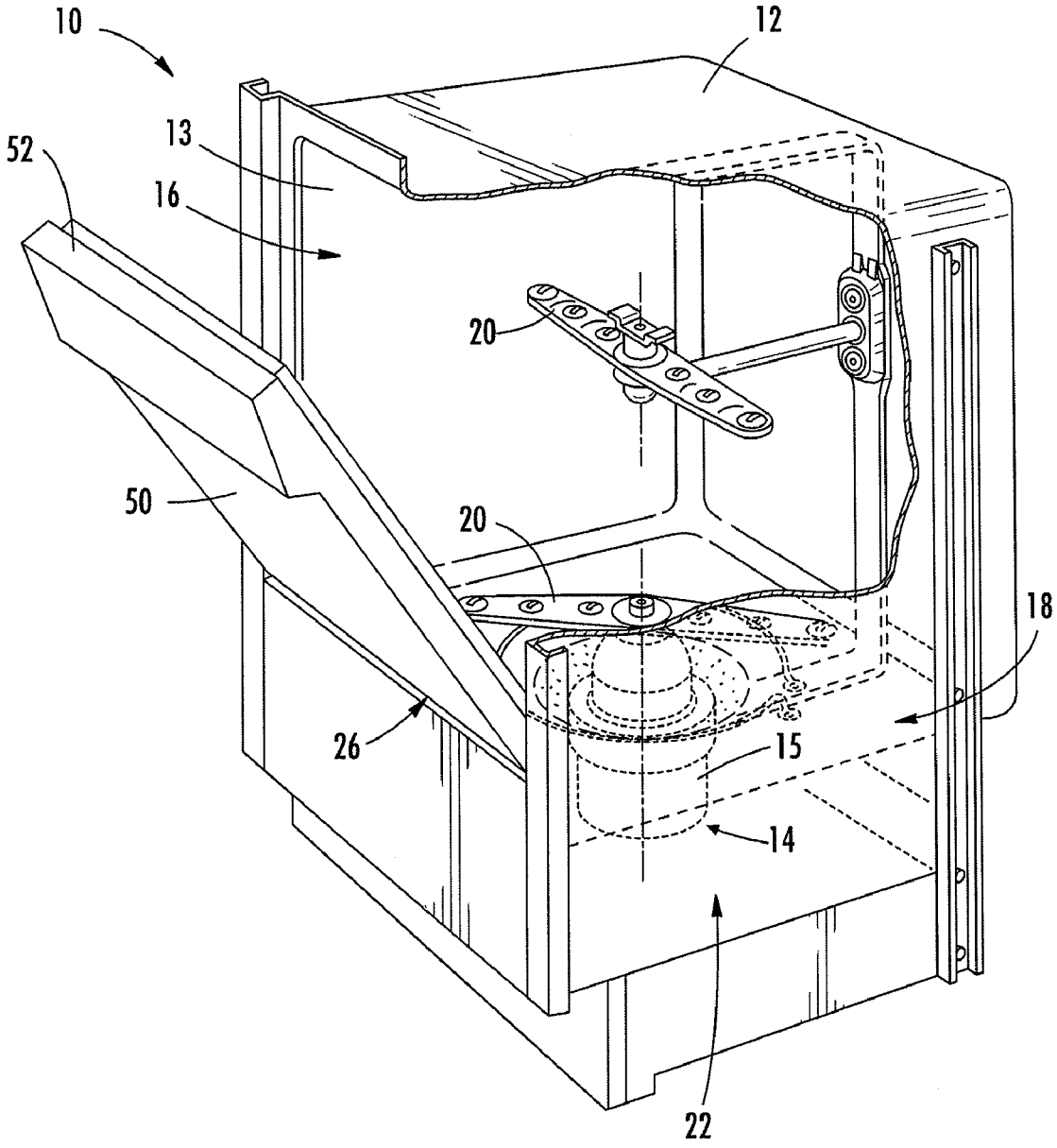
Figure 2:
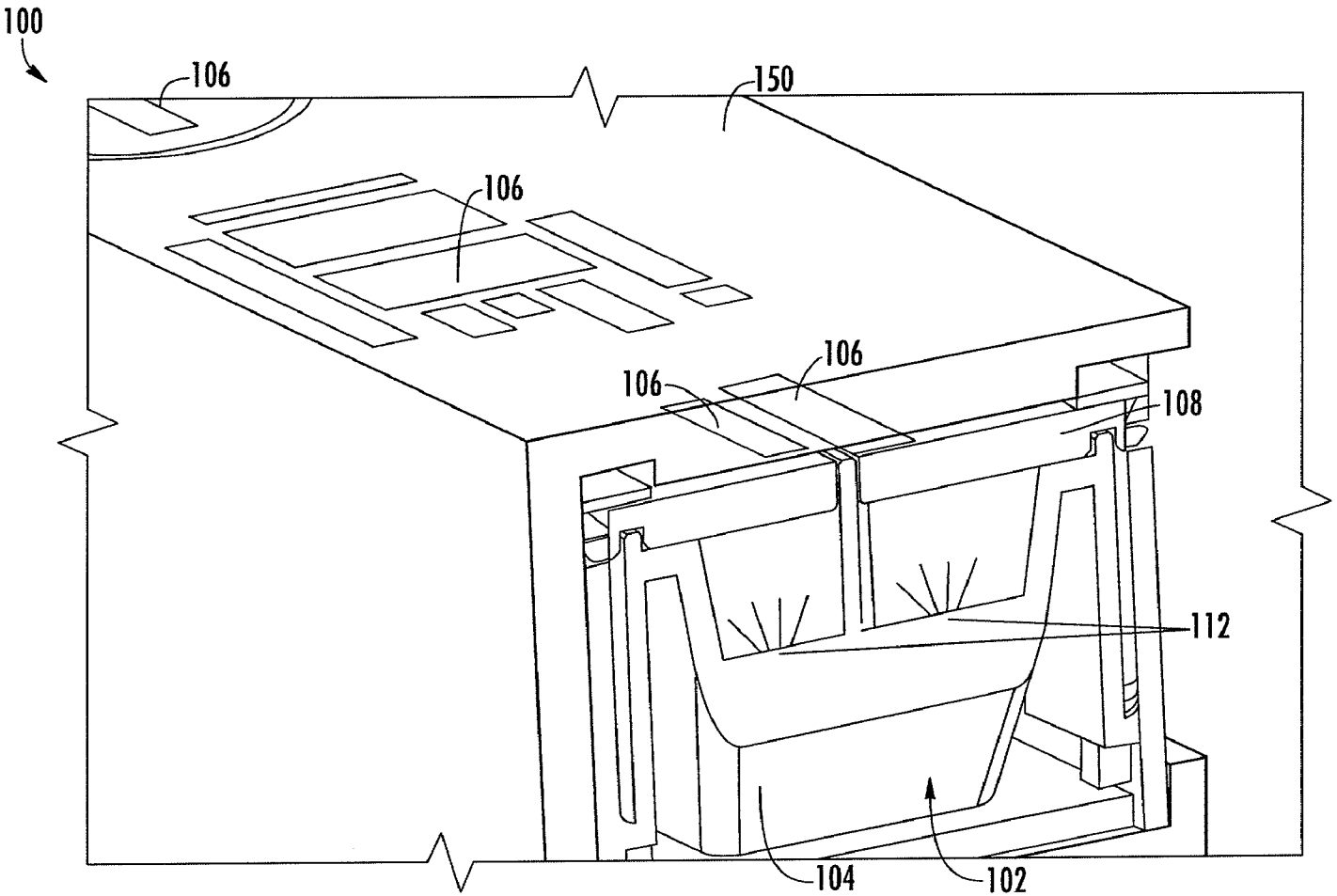
Figure 3:
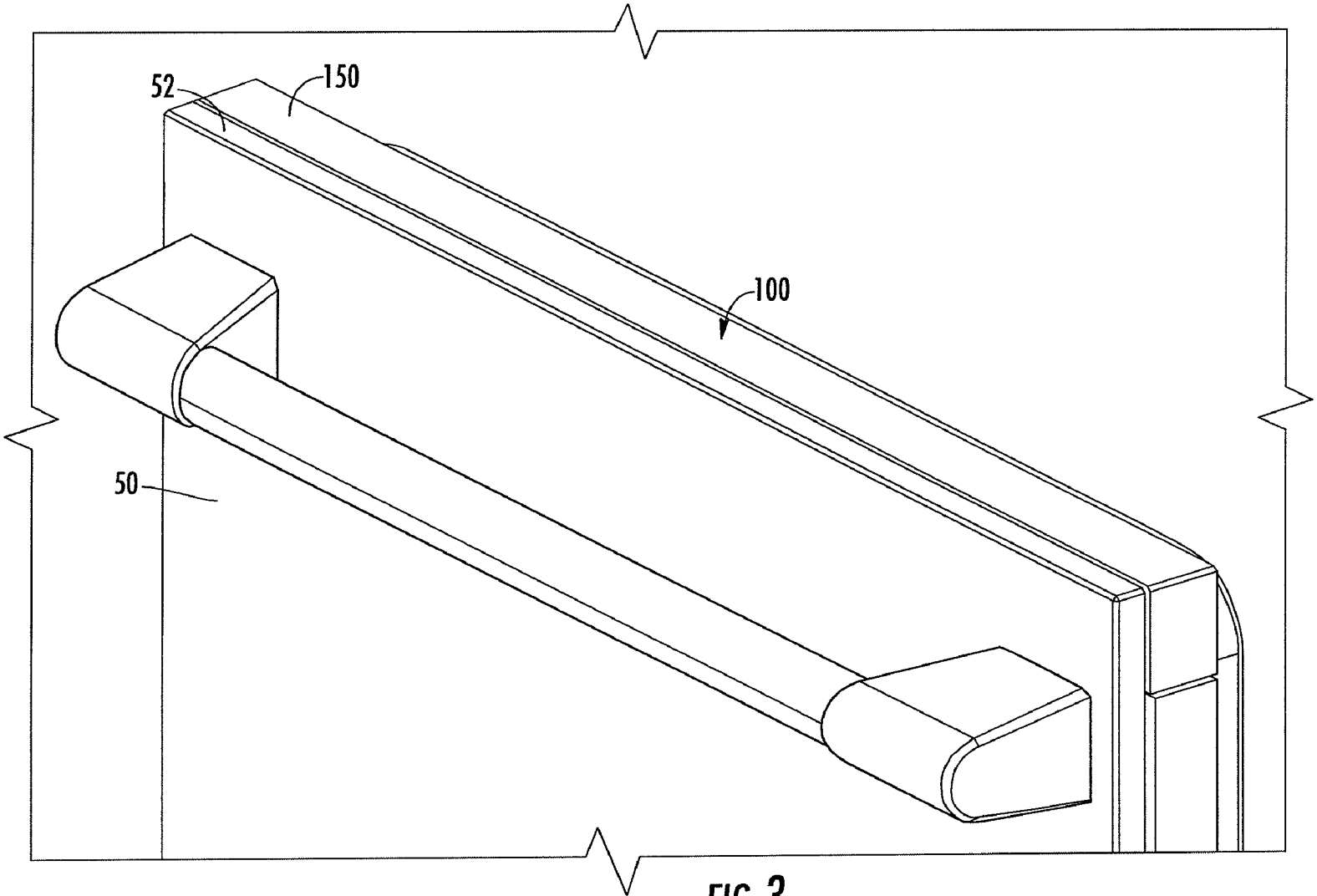
Figure 4:
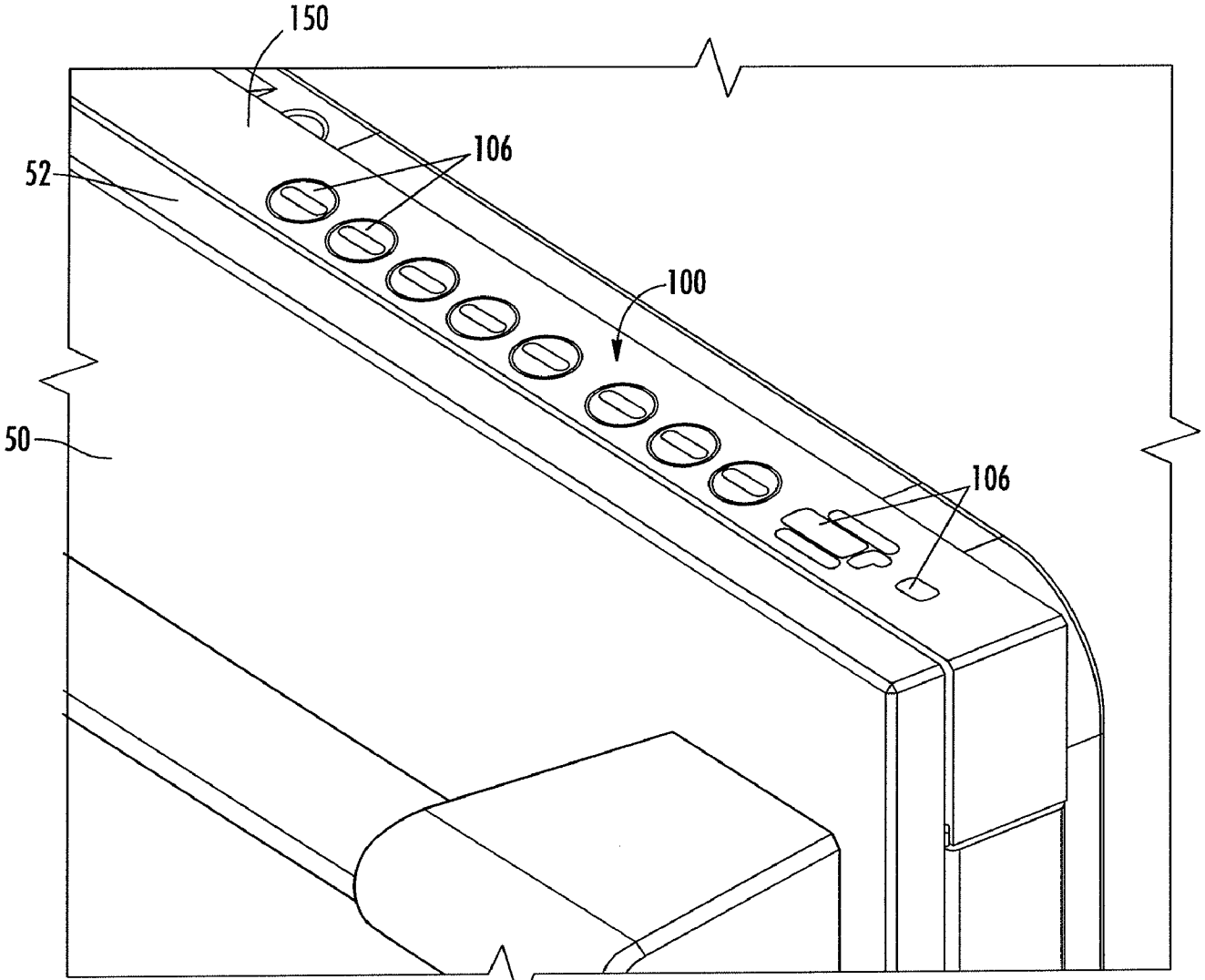

Having thus described various embodiments of the invention in general terms, reference will now be made to the accompanying drawings, which are not necessarily drawn to scale, and wherein:

FIG. 1 is a perspective view of a dishwashing appliance capable of implementing various embodiments of the present disclosure;

FIG. 2 is a cross-sectional view of a console assembly for a dishwashing appliance, illustrating a control device arrangement and a console cover member configured to at least partially cover the control device arrangement, according to one embodiment of the present invention;

FIG. 3 is a perspective view of a door assembly for a dishwashing appliance, illustrating a console assembly operably engaged with the door assembly about an upper end thereof, and the door assembly being in a closed position so as to cover a forward access opening of a tub portion, according to one embodiment of the present invention; and FIG. 4 is a perspective view of a door assembly for a dishwashing appliance, illustrating a console assembly operably engaged with the door assembly about an upper surface thereof, with the door assembly being pivoted from a closed position so as to permit access to a tub portion, and to illuminate at least one indicia associated with the control device assembly, according to one embodiment of the present invention.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details, and also referred to herein as "tub" or "tub 12") having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and dishware to be washed. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18, of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to cover and seal the forward access opening 16 in a closed position when the dishwasher 10 is in operation, and to provide access to the interior of the tub portion 12 through the forward access opening 16 when the door assembly 50 is pivoted from the closed position to an open position.

In accordance with embodiments of the present disclosure, with reference to FIGS. 2-4, the dishwasher 10 may include a console assembly 100 configured to include one or more elements (i.e., a user interface) capable of directing the operation/actuation of various operational components of the dishwasher 10. The console assembly 100 comprises a control device arrangement 102 which may include, for example, a circuit board, a timer device or other control unit (for controlling certain aspects of the dishwasher 10) that is otherwise in electrical communication with one or more control actuators 104 and/or user interface, which may be mounted in/on the door assembly 50 of the dishwasher 10 or otherwise associated with the door assembly 50. The control device arrangement 102 may further be in communication, via a wiring arrangement (not shown), such as, for example, a wiring harness, with various operational components (e.g., circulation pump, drain pump, water valve) of the dishwasher 10, wherein such operational components may thus be controlled via the console assembly 100/control device arrangement 102, as initiated through the control actuators 104 and/or user interface associated with the door assembly 50. The console assembly 100 may be mounted or otherwise secured to the door assembly 50 about an upper end 52 thereof, wherein the control actuators 104 are accessible by a user via the upper end 52 of the door assembly 50. In some instances, the console assembly 100 may be engaged with the door assembly 50 in a dedicated recess (not shown) defined thereby and configured to receive the console assembly 100 in a defined space. Further, the console assembly 100 may be mounted to the door assembly 50 in such a manner that the console assembly 100 cooperates with the door assembly 50 to form the upper end 52.

As mentioned previously, the console assembly 100 includes the control device arrangement 102, which is configured to direct the operation of various operational components of the dishwasher 10. The control device arrangement 102 may comprise at least one control actuator 104 configured to selectively direct operation of at least one operational component of the dishwasher 10. In some instances, the control device arrangement 102 may comprise a plurality of control actuators 104 associated with various performed functions (i.e., wash, rinse, drain, heated dry) or cycles (i.e., normal wash, heavy wash, pre-rinse) that may be selected by a user interacting with the control actuator 104, such as, for example, pressing a button of the control device arrangement 102 disposed about the upper end 52 of the door assembly 50.

In this regard, the console assembly 100 may further comprise a console cover member 150 at least partially covering the control device arrangement 102. The console cover member 150 may be mounted, secured, or otherwise maintained with respect to the upper end 52/control device arrangement 102 in any suitable manner. In some instances, the console cover member may extend at least partially along the length of the control device arrangement 102 (i.e., laterally across the door assembly 50) and, in addition, may extend at least partially along a lateral side portion(s) of the door assembly 50. The console cover member 150 may be implemented in a water-tight configuration, if necessary, due to exposure thereof (i.e., the upper end 52) to humidity originating from within the tub portion 12 of the dishwasher 10. The console cover member 150 may be further configured such that the control actuator(s) 104 is accessible therethrough. That is, in some instances, the console cover member 150 may be comprised of a resilient and/or deformable material that is capable of at least partially deforming to permit interaction with the control actuator 104 by the user. In other instances, the control actuator(s) 104 may be touch-sensitive, with the console cover member 150 being accordingly configured to facilitate interaction with the touch-sensitive control actuator(s) 104.

Associated with each of the control actuator(s) 104 may be an indicia 106 such as, for example, a graphical element, an alphanumeric character, an actuator functionality element, and/or a status element, or the like, for indicating information to the user regarding the function of the control actuator 104 associated therewith. For example, the indicia 106 may indicate the control actuator 104 for a light, normal, or heavy wash program. In addition, in some instances, the indicia 106 may be provided in a manner that is not associated with a control actuator 104 for providing additional information to the user such as, for example, remaining run time of the dishwasher, clock time, etc. In some instances, the indicia 106 may be stenciled into or inlaid in a particular component/member associated with a light diffuser 108, or may be otherwise associated with a light diffuser member 108 associated with the control device arrangement 102, as further disclosed herein. In other instances, the indicia 106 may be stenciled into, inlaid in, or otherwise associated with the console cover member 150

In some instances, the control device arrangement 102 further include at least one light emitting element 112 associated therewith, such as, for example, a light emitting diode (LED), for illumination of the actuator(s) 104 and/or indicia(s) 106 in certain situations. More particularly, in furtherance of concealing the actuator(s) 104 and/or indicia(s) 106 of the control device arrangement 102 when not in use, the console cover member 150 may be configured to be substantially opaque when the door assembly 50 is in the closed position (or otherwise the console cover member 150 may be normally opaque). In such instances, the door assembly 50 in the closed position may be associated with de-actuation of the light emitting element(s) 112, thereby obscuring observation of the actuator(s) 104 and/or indicia(s) 106 when the door assembly 50 is in the closed position. That is, when the door assembly 50 of the dishwasher 10 is in the closed position, the light emitting element(s) 112 may be de-actuated such that the actuator(s) 104 and/or indicia(s) 106 are not visible through the normally-opaque console cover, as shown in FIG. 3. In this manner, the "clean look" appearance of the dishwasher can be maintained. That is, the opaqueness of the console cover member 150, as well as the lack of illumination when the door assembly 50 is in the closed position, effectively conceals the actuator(s) 104 and/or indicia(s) 106 of the control device arrangement 102 for being viewed externally to the dishwasher.

However, since the actuator(s) 104 of the control device arrangement 102 is likely to be used to control the dishwasher when the door assembly 50 is in the open position, it is desirable that the actuator(s) 104 and/or indicia(s) 106 be visible in such instances. Accordingly, the light emitting element 112 may be configured to be actuated when the door assembly 50 is pivoted from the closed position, for illuminating the actuator(s) 104 and/or indicia(s) 106. In conjunction with the actuation of the light emitting element 112, the console cover member 150 may also be configured to be (or become) at least partially translucent, upon the door assembly 50 being pivoted from the closed position, so as to allow observation of the actuator(s) 104 and/or indicia(s) 106. That is, when the door assembly 50 of the dishwasher 10 is opened, the light emitting element(s) 112 associated with the control device arrangement 102 may be configured to be actuated such that the light emitted thereby, and indicative of the actuator(s) 104 and/or indicia(s) 106, becomes visible through the console cover member 150, as shown in FIG. 4.

The light emitting element(s) 112 may be particularly associated with a corresponding indicia 106 and/or control actuator 104. In this manner, the light emitting element(s) 112 may be actuated and de-actuated to selectively illuminate the particular indicia 106, which, in some instances, is associated with the particular control actuator 104. For example, the indicia 106 may comprise a "START" alphanumeric character inlaid or otherwise associated with the console member 150. In this instance, the control actuator 104 associated with the "START" indicia 106 may be actuated via the console cover member 150 to implement a wash program previously selected by the user. Further, to illuminate the "START" indicia 106, the light emitting element 112 associated therewith may be actuated when the door assembly 50 is pivoted from the closed position to thereby particularly indicate the location of the corresponding control actuator 104 via the particular indicia 106 associated with the console cover member 150 so that the user can interact therewith.

In other instances, the light emitting element(s) 112 may not be specifically associated with a particular indicia 106 and/or control actuator 104. That is, the light emitting element(s) 112 may be configured to non-specifically illuminate the control actuator(s) 104 and/or indicia(s) 106 associated with the control device arrangement 102. As such, some aspects of the present invention may include one or more light diffuser members 108 associated with the light emitting element(s) 112 for diffusing the light emitted thereby. In such instances, the indicia(s) 106 may be inlaid in the light diffuser member 108, formed in an inlaid member (not shown) associated with the light emitting element 112, or otherwise associated with the light diffuser member 108. The light diffuser member 108 may be in communication with the light emitting element 112 such that light emitted thereby at least partially interacts with (i.e., directed through) the light diffuser member 108 so as to illuminate the actuator 104 and/or the indicia 106. In some particular aspects of the present invention, the light emitting element(s) 112 may cooperate with the light diffuser member(s) 108 so as to non-specifically illuminate the actuator(s) 104 and/or indicia(s) 106. That is, the light emitting element(s) 112 and the light diffuser member(s) 108 generally illuminate some or all of the actuator(s) 104 and/or indicia(s) 106 simultaneously (i.e., along the length of the control device arrangement 102), instead of particular actuator(s) 104 and/or indicia(s) 106 (though the use of such light diffuser element(s) 108 does not preclude the light emitting element(s) 112 from illuminating particular actuator(s) 104 and/or indicia(s) 106). In some instances, the light diffuser member(s) 108 may be physically disposed between the light emitting element(s) 112 and the corresponding actuator(s) 104 and/or indicia(s) 106.

Many modifications and other embodiments of the inventions set forth herein will come to mind to one skilled in the art to which these inventions pertain having the benefit of the teachings presented in the foregoing descriptions and the associated drawings. For example, the light emitting element(s) 112 may be configured to emit various colors of light, wherein the particular color may be selectable by the user according to user preference. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A console assembly for a dishwashing appliance having a tub portion defining a forward access opening, and a door assembly pivotably engaged therewith and movable between an open position and a closed position, the door assembly in the closed position cooperating with the tub portion to cover the forward access opening, the door assembly defining an upper end opposed to a lower end with respect to the forward access opening, the console assembly being adapted to operably engage the upper end and comprising:

a control device arrangement, including:

a control actuator having an indicia associated therewith and being adapted to selectively direct operation of at least one operational component of the dishwashing appliance;

a light emitting element associated with the control actuator, the light emitting element being configured so as to be de-actuated when the door assembly is in the closed position, and to be actuated to emit light when the door assembly is pivoted from the closed position; and a light diffuser member in communication with the light emitting element such that light emitted thereby interacts with the light diffuser member to illuminate the indicia associated with the control actuator; and a console cover member configured to at least partially cover the control device arrangement and to facilitate interaction with the control actuator therethrough, the console cover member also being configured such that the light from the diffuser member illuminating the indicia is non-specifically directed therethrough, the console cover member being further configured to be substantially opaque when the light emitting element is de-actuated, to prevent observation of the indicia associated with the control actuator when the door assembly is in the closed position, and to be at least partially translucent when the light emitting element is actuated, upon the door assembly being pivoted from the closed position, so as to allow observation of the indicia associated with the control actuator.

2. The console assembly according to claim 1 wherein the indicia associated with the light emitting element is defined by the light diffuser member.

3. The console assembly according to claim 1 wherein the indicia associated with the light emitting element is defined by an inlaid member coupled to the light diffuser member.

4. The console assembly according to claim 1 wherein the indicia associated with the light emitting element is defined by the console cover member.

5. The console assembly according to claim 1 wherein the indicia comprises at least one of a graphical element, an alphanumeric character, an actuator functionality element, and a status element.

6. The console assembly according to claim 1 wherein the control device arrangement comprises a plurality of light emitting elements, each light emitting element being configured to be individually actuated upon actuation of the corresponding control actuator, the remaining light emitting elements remaining de-actuated such that the actuated control actuator is identified by the indicia associated therewith.

7. The console assembly according to claim 1 wherein the light emitting element comprises a light emitting diode.

8. A dishwashing appliance comprising:

a tub portion defining a forward access opening;

a door assembly pivotably engaged with the tub portion and movable between an open position and a closed position, the door assembly in the closed position cooperating with the tub portion to cover the forward access opening, the door assembly defining an upper end opposed to a lower end with respect to the forward access opening; and a console assembly operably engaged with the door assembly about the upper end thereof, and comprising:

a control device arrangement, including:

a control actuator having an indicia associated therewith and being adapted to selectively direct operation of at least one operational component of the dishwashing appliance;

a light emitting element associated with the control actuator, the light emitting element being configured so as to be de-actuated when the door assembly is in the closed position, and to be actuated to emit light when the door assembly is pivoted from the closed position; and a light diffuser member in communication with the light emitting element such that light emitted thereby interacts with the light diffuser member to illuminate the indicia associated with the control actuator; and a console cover member configured to at least partially cover the control device arrangement and to facilitate interaction with the control actuator therethrough, the console cover member being further configured such that the light from the diffuser member illuminating the indicia is non-specifically directed therethrough, the console cover member being further configured to be substantially opaque when the light emitting element is de-actuated, to prevent observation of the indicia associated with the control actuator when the door assembly is in the closed position, and to be at least partially translucent when the light emitting element is actuated, upon the door assembly being pivoted from the closed position, so as to allow observation of the indicia associated with the control actuator.

9. The dishwashing appliance according to claim 8 wherein the indicia associated with the light emitting element is defined by the light diffuser member.

10. The dishwashing appliance according to claim 8 wherein the indicia associated with the light emitting element is defined by an inlaid member coupled to the light diffuser member.

11. The dishwashing appliance according to claim 8 wherein the indicia associated with the light emitting element is defined by the console cover member.

12. The dishwashing appliance according to claim 8 wherein the indicia comprises at least one of a graphical element, an alphanumeric character, an actuator functionality element, and a status element.

13. The dishwashing appliance according to claim 8 wherein the control device arrangement comprises a plurality of light emitting elements, each light emitting element being configured to be individually actuated upon actuation of the corresponding control actuator, the remaining light emitting elements remaining de-actuated such that the actuated control actuator is identified by the indicia associated therewith.

14. The dishwashing appliance according to claim 8 wherein the light emitting element comprises a light emitting diode.

* * * * *